US011569615B1

(12) United States Patent
Sun et al.

(10) Patent No.: US 11,569,615 B1
(45) Date of Patent: Jan. 31, 2023

(54) CABLE CONNECTOR

(71) Applicant: JESS-LINK PRODUCTS CO., LTD., New Taipei (TW)

(72) Inventors: Chi-Hsien Sun, New Taipei (TW); Ching-Hung Liu, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 44 days.

(21) Appl. No.: 17/409,775

(22) Filed: Aug. 23, 2021

(30) Foreign Application Priority Data

Jul. 15, 2021 (TW) ..... 110208307

(51) Int. Cl.
*H01R 13/516* (2006.01)
*H01R 13/633* (2006.01)
*H01R 13/514* (2006.01)
*H01R 13/627* (2006.01)

(52) U.S. Cl.
CPC ..... *H01R 13/6335* (2013.01); *H01R 13/514* (2013.01); *H01R 13/627* (2013.01)

(58) Field of Classification Search
CPC . H01R 13/6335; H01R 13/514; H01R 13/627
See application file for complete search history.

(56) References Cited

U.S. PATENT DOCUMENTS 8,251,735 B2 * 8/2012 Wu ..... H01R 13/5825 439/353
8,308,377 B2 * 11/2012 Yi ..... G02B 6/4261 385/53
10,193,268 B1 * 1/2019 Chow ..... H01R 12/53
2009/0291578 A1 * 11/2009 Wu ..... H01R 13/6335 439/258
2019/0027866 A1 * 1/2019 Wu ..... H01R 13/6335

* cited by examiner

*Primary Examiner* — Truc T Nguyen
(74) *Attorney, Agent, or Firm* — Chun-Ming Shih; HDLS IPR Services

(57) ABSTRACT

A cable connector includes a case, a fastener and an unlocking member. At least one side of the case has a texture area with a guide surface which is a smooth surface. The fastener is attached on the case and extended with a flexible arm. Part of the flexible arm is attached to the guide surface. The unlocking member includes a handle and a pushing block connected to the handle. The pushing block is sandwiched between the case and the flexible arm. When the unlocking member is pulled, the pushing block moves along the guide surface to separate the flexible arm from the case. When the unlocking member is released, the pushing block is pressed by the flexible arm to slide and return along the guide surface. The pushing block may return to original position without elasticity of a spring to simplify the structure and save the costs.

10 Claims, 5 Drawing Sheets

CABLE CONNECTOR

BACKGROUND

Technical Field

The disclosure relates to a connector, particularly to a cable connector which uses a flexible arm to push an unlocking member to return.

Related Art

The case of a general cable connector is easy to be scratched in the process of manufacturing or assembling. The functions are non-defective, but it is judged as a defective product in the external assessment so as to seriously affect the yield rate in the production line. Therefore, most of related-art cable connectors adopt rough surfaces.

In addition, when a related-art cable connector is connected with a corresponding connector, a flexible latch may be used for fastening. Thus, such a cable connector is often provided with a moving member corresponding to the flexible latch so that the flexible latch is pushed away by the moving member to unlock. However, after unlocked, the released moving member is restricted by the rough surfaces of the case so that it is hard to be pushed to return by elasticity of the flexible latch. Thus, the moving member needs an additional spring for returning. That makes the assembling process become complicated and increases the production costs.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY

An object of the disclosure is to use the flexible arm to push the unlocking member so that the moving member may return without elasticity of a spring to simplify the structure and save the costs.

To accomplish the above object, the disclosure provides a cable connector, which includes a case, a fastener and an unlocking member. At least one side of the case has a texture area. The texture area is provided with a guide surface. The guide surface is a smooth (polished) surface. The fastener is attached on the case and extended with a flexible arm. Part of the flexible arm attaches to the guide surface. The unlocking member includes a handle and a pushing block connected to the handle. The pushing block is sandwiched between the case and the flexible arm. When the unlocking member is pulled, the pushing block moves along the guide surface to separate the flexible arm from the case. When the unlocking member is released, the pushing block is pressed by the flexible arm to slide and return along the guide surface.

The disclosure further has the following functions. At least one side of the case has a texture area, that may reduce scratches to be formed on the texture area. The distal end of the flexible arm is provided with a hook, so the cable connector may be latched to the hole of the corresponding connector to avoid separation. An end of the handle, which is opposite to the pushing block, projects from the case and is provided with a holding portion, that is convenient to be nipped by a user to pull the handle. The guide bar in the guide trough may limit the movement of the handle. The handle may slide without forcing to return to the original position along the oblique surface of the guide surface by the pressure from the flexible arm with respect to the smooth surfaces of the pushing block, flexible arm and guide surface.

DETAILED DESCRIPTION

Figure 1:
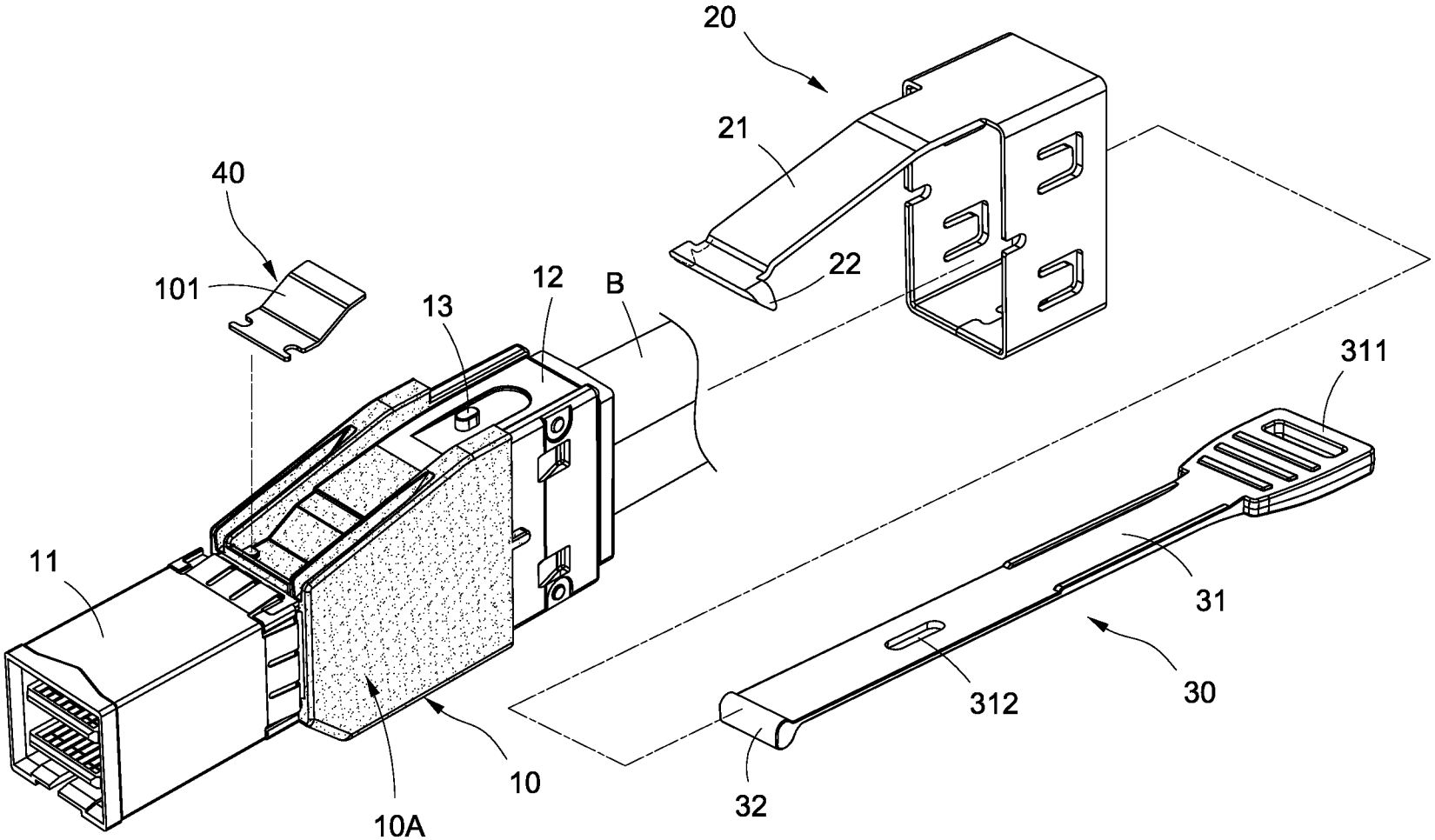
FIG. 1 is an exploded view of the disclosure.
Figure 2:
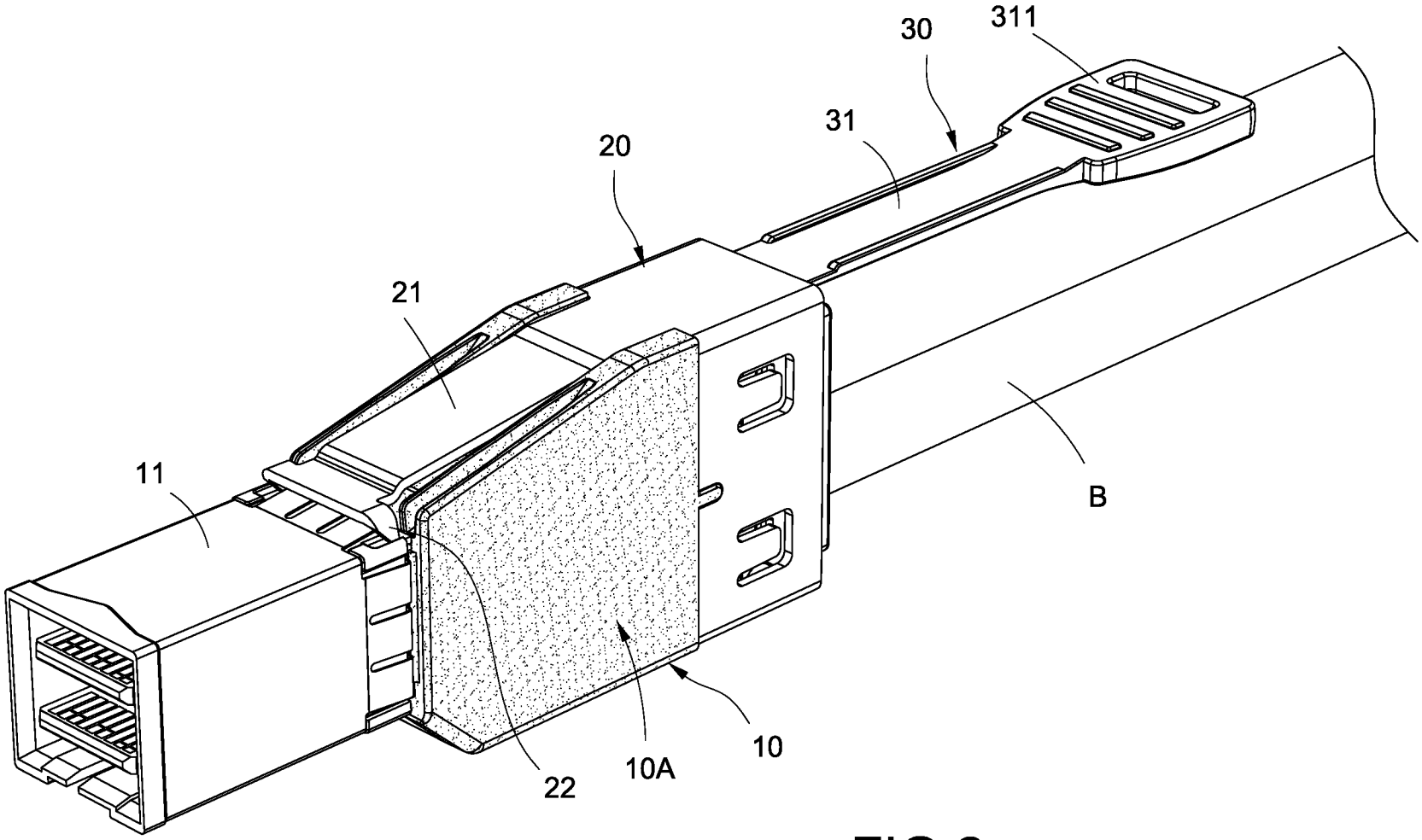
FIG. 2 is an assembled view of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

The disclosure provides a cable connector, which may be connected to a corresponding connector A. Please refer to FIGS. 1-4, which show the first embodiment of the disclosure. The cable connector includes a case 10, a fastener 20 and an unlocking member 30.

In the embodiment, the case 10 is approximately of a pillar-shape cuboid and is made of zinc alloy. At least one side of the case 10 has a texture area 10A. The surface of the texture area 10A is a texture surface so as to reduce scratches to be formed on the texture area 10A. In the embodiment, the texture area 10A may be formed by, but not limited to, sandblasting or laser processing. The case 10 has a connecting end 11 and a wiring end 12. The connecting end 11 may be plugged with the corresponding connector A. The wiring end 12 is passed by the cable B to allow the cable B to enter the case 10. In the embodiment, the texture area 10A is formed only on the surface between the connecting end 11 and the wiring end 12 of the case 10. In some embodiments, the texture area 10A may also be formed on the whole surface of the case 10 to accomplish a better effect of anti-scratch and the consistency of appearance. The texture area 10A of the top of the case 10 is provided with a guide surface 101. The guide surface 101 is located between the connecting end 11 and the wiring end 12 and is longitudinally extended along the case 10. The guide surface 101 is a smooth (polished) surface.

In the embodiment, the cable connector further includes a metal sheet 40 made of stainless steel or other metal. The metal sheet 40 is disposed between the connecting end 11 and the wiring end 12 and attached on the texture area 10A of the top of the case 10. The guide surface 101 is formed on the top of the metal sheet 40. In the embodiment, the guide surface 101 is an oblique surface and the oblique surface gradually leaves the central axis X of the case 10 from the connecting end 11 toward the wiring end 12. In other words, the distance between the oblique surface and the central axis X of the case 10 is gradually increased from the connecting end 11 toward the wiring end 12. The disclosure is not limited to this, for example, the guide surface 101 may also be a protrusive structure leaving the central axis X of the case 10 from the connecting end 11 toward the wiring end 12.

The fastener 20 is made of stainless or other metal. In the embodiment, the fastener 20 is approximately of a hollow cuboidal case and is attached on the wiring end 12 of the case 10. In some embodiments, the fastener 20 may engage with the case 10 to prevent the fastener 20 from separating from the case 10. A side of the fastener 20 is extended with a flexible arm 21. The surface of the flexible arm 21 is a smooth (polished) surface. Part of the flexible arm 21 attaches to the guide surface 101. The distal end of the flexible arm 21 is provided with a hook 22. The corresponding connector A is provided with a hole A1. The hook 22 may hook in the hole A1 to prevent the cable connector of the disclosure from separating from the corresponding connector A.

The unlocking member 30 is made of stainless steel or other metal. The unlocking member 30 includes a handle 31 and a pushing block 32 connected to the handle 31. The handle 31 is movably sandwiched between the fastener 20 and the case 10. An end of the handle 31, which is opposite to the pushing block 32 (that is, away from the pushing block 32), projects from the case 10 and is provided with a holding portion 311. The surface of the holding portion 311 is provided with multiple protrusive strips to facilitate the user nipping the holding portion 311 to pull the handle 31. The pushing block 32 is sandwiched between the case 10 and the flexible arm 21. The surface of the pushing block 32 is a smooth (polished) surface. Also, the handle 31 is penetrated with a guide trough 312. The case 10 is protruded with a guide bar 13 corresponding to the guide trough 312. The guide bar 13 passes the guide trough 312. The guide bar 13 in the guide trough 312 may restrict the movement of the handle 31.

Figure 3:
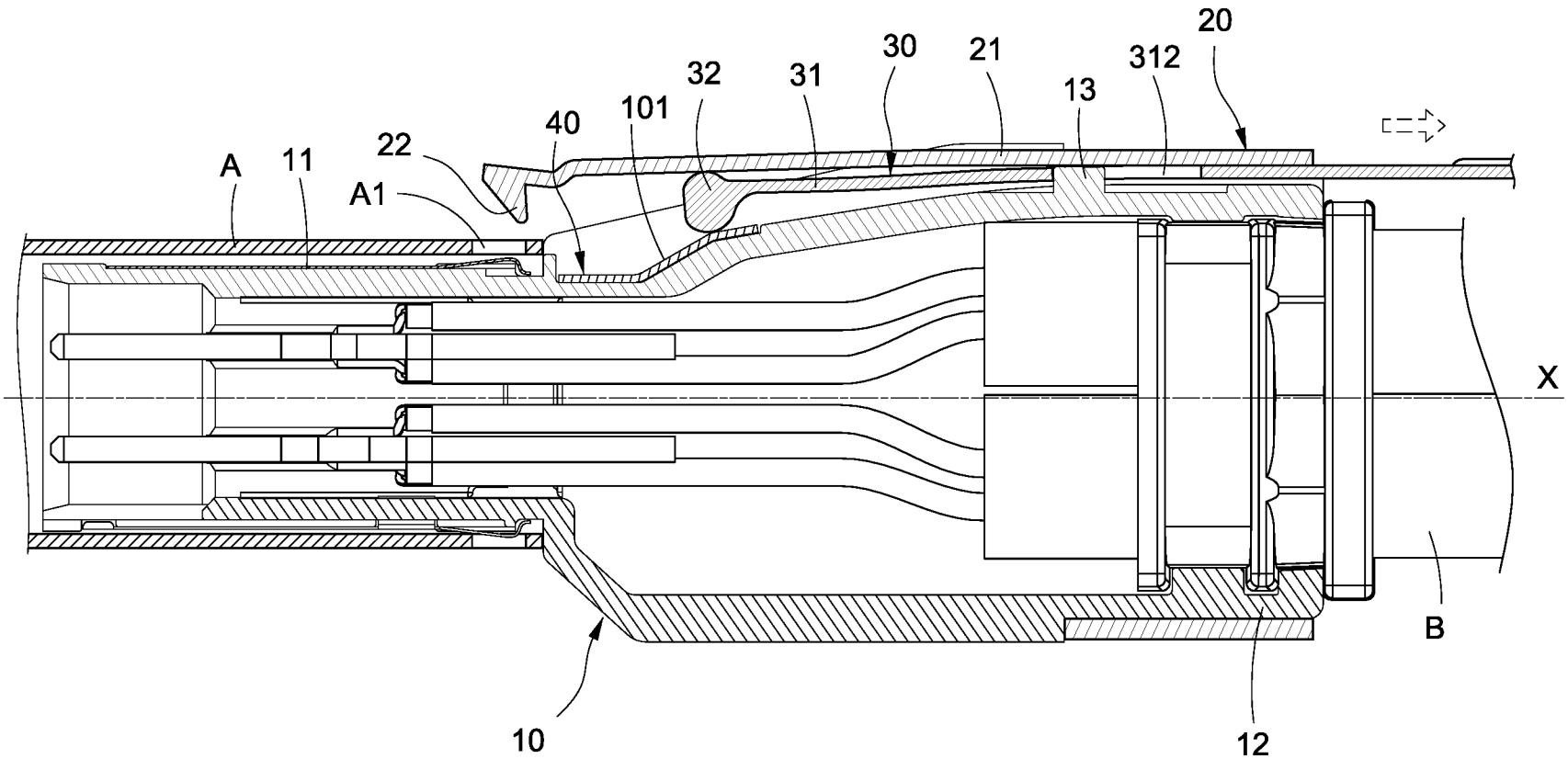
FIG. 3 is cross-sectional view when the disclosure is unlocked with a corresponding connector.
Figure 4:
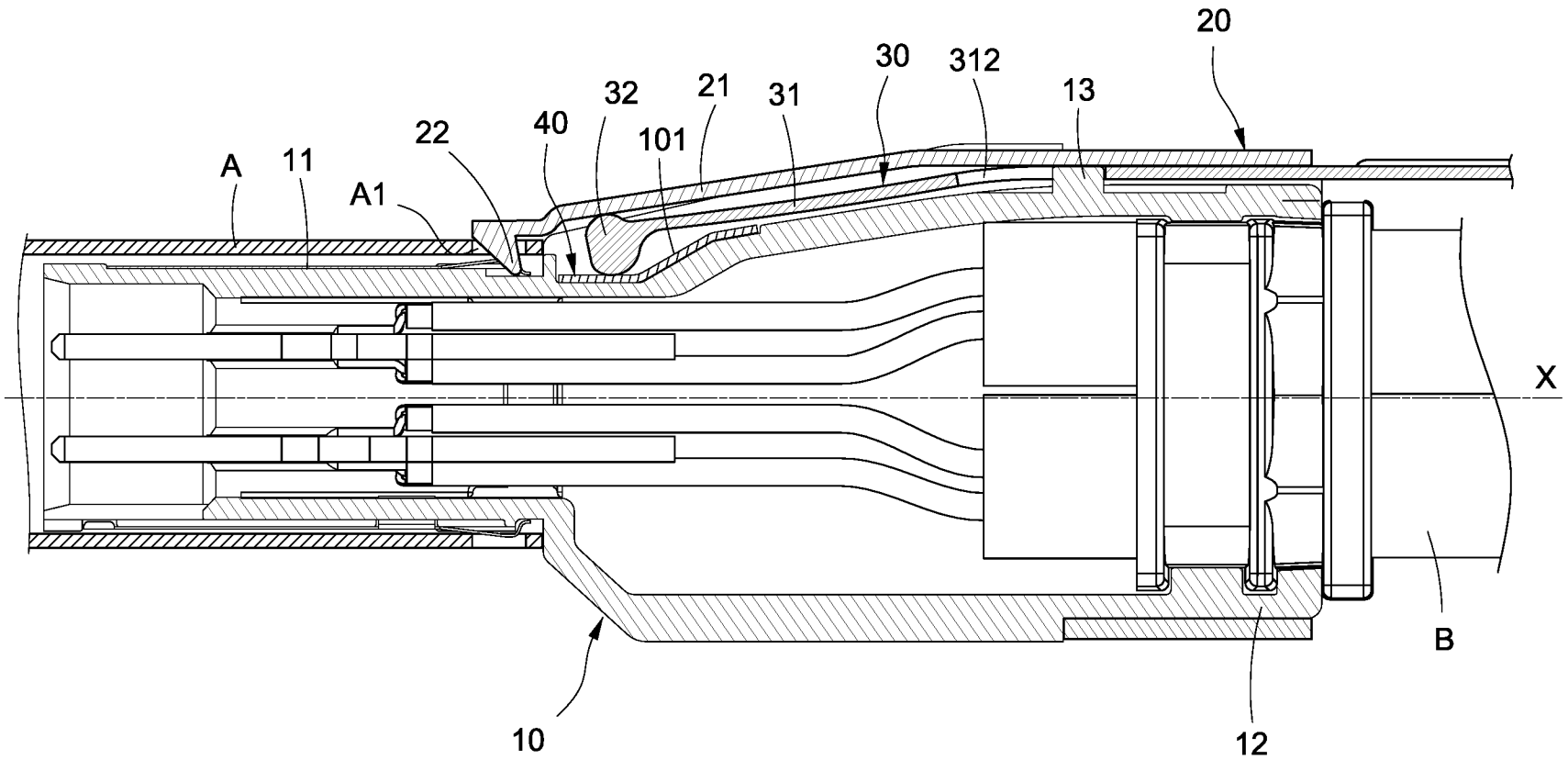
FIG. 4 is cross-sectional view when the disclosure is engaged with a corresponding connector.

Please refer to FIG. 3. When the handle 31 of the unlocking member 30 is rearward pulled, the pushing block 32 moves along the guide surface 101 to separate the flexible arm 21 from the case 10 to make the hook 22 of the flexible arm 21 separate from the hole A1 of the corresponding connector A. Thus, the cable connector may be unlocked from the corresponding connector A. Please refer to FIG. 4. When the handle 31 of the unlocking member 30 is released, because of the smooth metal surfaces with low coefficient of friction of the pushing block 32, the flexible arm 21 and the guide surface 101, the pushing block 32 may slide and return along the guide surface 101 by the flexible pressure from the flexible arm 21 and the hook 22 of the flexible arm 21 hooks the hole A1 of the corresponding connector A so as to fix the cable connector and the corresponding connector A.

Figure 5:
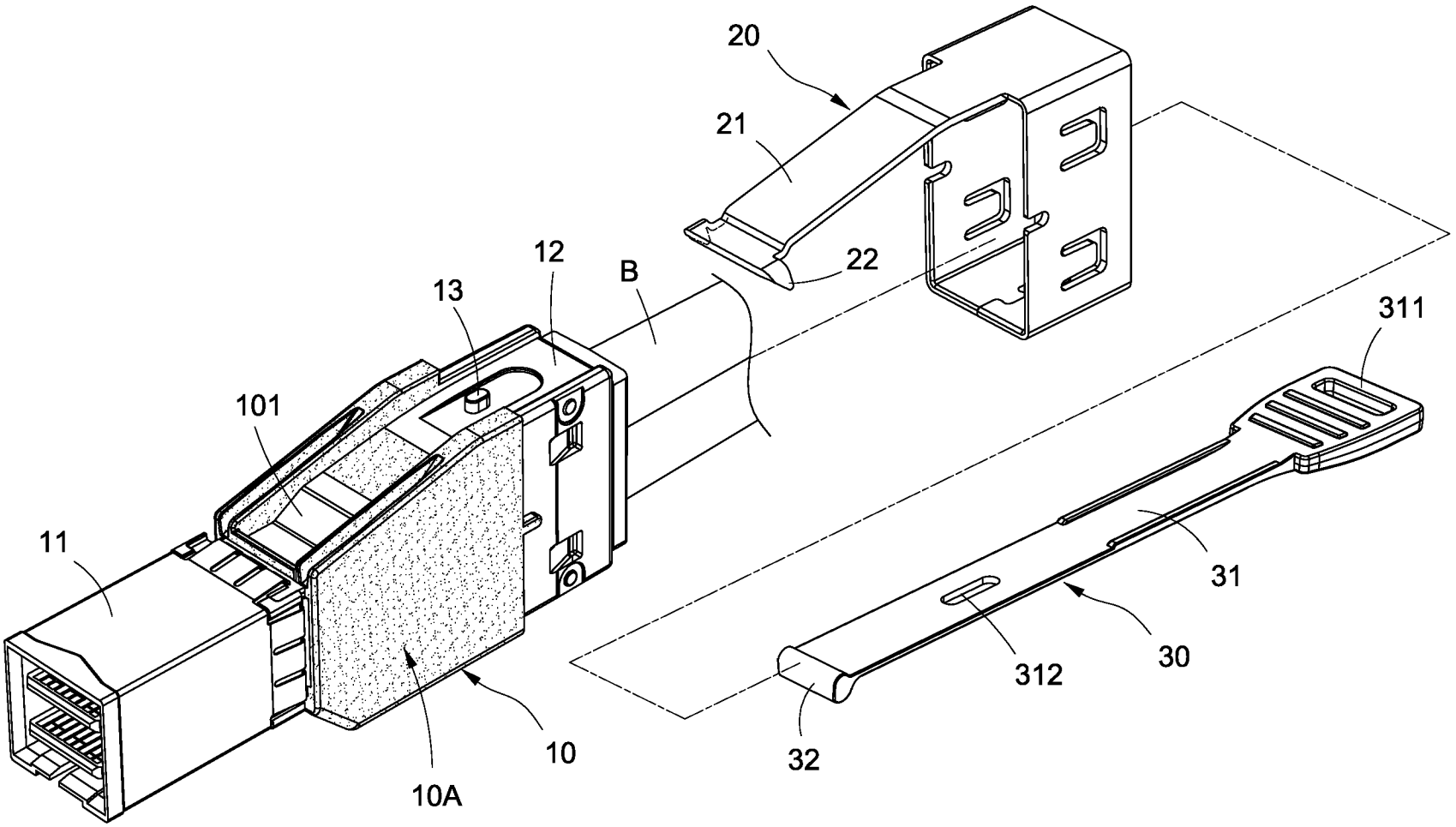
FIG. 5 is an exploded view of another embodiment of the disclosure.

Please refer to FIG. 5, which shows another embodiment of the disclosure. The primary difference is that the guide surface 101 is part of the case 10 and formed in one piece with the case 10. The smooth surface of the guide surface 101 may be formed by polishing. The texture area 10A of the case 10 may be formed by sandblasting or laser processing. A masking sheet may be adhered on the guide surface 101 to keep the smooth surface when the sandblasting treatment is performed to the case. This may also accomplish the objects of reducing scratches, simplifying the structure and saving the costs of the disclosure.

While this disclosure has been described by means of specific embodiments, numerous modifications and variations could be made thereto by those skilled in the art without departing from the scope and spirit of this disclosure set forth in the claims.

What is claimed is:

1. A cable connector comprising:

a case, comprising a texture area disposed on at least one side thereof and a guide surface disposed on the texture area, wherein the guide surface is in a polished manner;

a fastener, attached on the case and comprising a flexible arm extended therefrom, and a part of the flexible arm attached to the guide surface; and an unlocking member, comprising a handle and a pushing block connected to the handle, and the pushing block sandwiched between the case and the flexible arm;

wherein when the unlocking member is pulled, the pushing block moves along the guide surface to separate the flexible arm from the case;

wherein when the unlocking member is released, the pushing block is pressed by the flexible arm to slide and return along the guide surface.

2. The cable connector of claim 1, further comprising: a metal sheet attached on the texture area, and the guide surface is disposed on a top of the metal sheet.

3. The cable connector of claim 1, wherein the guide surface comprises an oblique surface.

4. The cable connector of claim 1, wherein the case is of a pillar shape and comprises a connecting end and a wiring end, and the guide surface is located between the connecting end and the wiring end and is longitudinally extended along the case.

5. The cable connector of claim 4, wherein a distance between the guide surface and a central axis of the case is gradually increased from the connecting end toward the wiring end.

6. The cable connector of claim 1, wherein a surface of the pushing block and a surface of the flexible arm are in the polished manner.

7. The cable connector of claim 1, wherein the handle is movably sandwiched between the fastener and the case.

8. The cable connector of claim 7, wherein the handle comprises a guide trough, the case comprises a guide bar disposed protrusively thereon and corresponding to the guide trough, and the guide bar passes the guide trough to restrict a movement of the handle.

9. The cable connector of claim 1, wherein an end of the handle away from the pushing block is projected from the case.

10. The cable connector of claim 1, wherein a distal end of the flexible arm comprises a hook.

* * * * *